US006167716B1

(12) United States Patent
Fredrick

(10) Patent No.: US 6,167,716 B1
(45) Date of Patent: Jan. 2, 2001

(54) CONDENSATE EVAPORATOR APPARATUS

(75) Inventor: Suzanne Fredrick, Newport Beach, CA (US)

(73) Assignee: Fredrick Family Trust, Los Angeles, CA (US)

( * ) Notice: Under 35 U.S.C. 154(b), the term of this patent shall be extended for 0 days.

(21) Appl. No.: 09/363,565

(22) Filed: Jul. 29, 1999

(51) Int. Cl.[7] ..... F25B 5/00
(52) U.S. Cl. ..... 62/283; 62/290
(58) Field of Search ..... 62/283, 285, 290, 62/291, 275

(56) References Cited

U.S. PATENT DOCUMENTS

| | | | |
|---|---|---|---|
| 2,089,953 | 8/1937 | Gaugler | 62/103 |
| 2,667,042 | 1/1954 | Anderson | 62/117.8 |
| 2,709,900 | 6/1955 | Zearfoss et al. | 62/103 |
| 3,059,446 | 10/1962 | Constantini et al. | 62/150 |
| 3,280,580 | 10/1966 | Constantini et al. | 62/275 |
| 3,412,571 | 11/1968 | Bolynn | 62/188 |
| 3,679,867 | 7/1972 | Canter | 219/272 |
| 3,750,418 | 8/1973 | Maudlin | 62/290 |
| 4,431,905 | 2/1984 | Slocum | 219/274 |
| 4,766,737 | 8/1988 | Baxter, II | 62/279 |
| 4,783,971 | 11/1988 | Alba | 62/291 |
| 4,829,780 | 5/1989 | Hughes et al. | 62/288 |
| 5,279,360 | 1/1994 | Hughes et al. | 165/111 |
| 5,341,653 | 8/1994 | Tippmann et al. | 62/288 |
| 5,341,870 | 8/1994 | Hughes et al. | 165/110 |
| 5,694,785 | 12/1997 | Balentine | 62/275 |

FOREIGN PATENT DOCUMENTS 2111183 6/1983 (GB) .

*Primary Examiner*—William Doerrler
*Assistant Examiner*—Melvin Jones
(74) *Attorney, Agent, or Firm*—Walter A. Hackler

(57) ABSTRACT

Condensate evaporator apparatus for a refrigeration unit generally includes a collection pan and a dissipator disposed directly over the collection pan for evaporating water introduced thereinto and for directing unevaporated water in the collection pan. A heater is disposed for selectively heating the dissipator means in order to enhance evaporation of water therefrom.

12 Claims, 2 Drawing Sheets

CONDENSATE EVAPORATOR APPARATUS

The present invention relates to condenser evaporator apparatus for a refrigeration unit and more specifically to a condensate evaporator apparatus with enhanced evaporation.

As is well known, commonly employed air conditioning and refrigeration systems operating on a vapor compression cycle utilize evaporators as a means of cooling the air. A refrigerant is flowed through an evaporator and expanded therein. In doing so, the refrigerant absorbs the heat of vaporization, thereby cooling the medium with which it is in contact, typically, heat exchanger tubes. The heat exchanger tubes sometimes include fins or the like for improved heat transfer. The air to be cooled is flowed over these tubes and fins, and as a result, the local air will be cooled beyond its dew point. As a result, water will condense out of the air onto the fins and tubes. This condensate must be removed or otherwise it will freeze and plug the air flow path.

A simple form of condensate removal involves the use of gravitational forces; in other words, the condensate is allowed to drop as it is formed into a drain or, if no drain is available, into a dissipator for evaporation.

A number of refrigeration systems, such as refrigerated display cases for perishable merchandise, are designed with a drip pan for collecting condensate. Often, such pans do not efficiently evaporate condensate water.

The present invention provides a combined dissipation drip pan, i.e., condensate evaporator apparatus, which provides for enhanced water evaporation.

SUMMARY OF THE INVENTION

Condensate evaporator apparatus for a refrigerator unit in accordance with the present invention generally includes a collection pan and a dissipator disposed directly over the collection pan which provides a means for evaporating water introduced thereinto and for directing unevaporated water into the collection pan.

Heating means is provided for selectively heating the dissipator means in order to enhance the evaporation of water therefrom. More particularly, the heating means may comprise an electrical element disposed in the collection pan. Float means, disposed in the collection pan, are provided for turning on the electrical element in response to a level of water accumulated in the condenser pan. Thus, the float means provides a means for detecting a selected level of water in the collection pan and providing an output for responding thereto. Control means may be provided for activating the heating element in response to the detective means output.

More particularly, the dissipator means may comprise a plurality of pans fixed in the spaced apart relationship with one another. The pans are aligned for condensate to flow from an upper pan downward to a lower pan and ultimately into the collection pan if the water is not totally evaporated during its course through the dissipator means.

Each of the plurality pans includes a rim for causing water to coat each of the plurality of pans to provide a greater area of evaporation. In addition, to facilitate the downward movement of excess water from each pan, each rim includes a spillway which provides means for enabling the water to spill onto an underlying pan.

Importantly, the heating element is disposed only under a portion of the dissipator means in order to cause circulation of heat and evaporation through the dissipator means. More particularly, the heating element is disposed adjacent sides of the plurality of pans opposite the spillway means and preferably the heating means is disposed only under one quadrant of the plurality of pans. This selected positioning of the heating element causes an convective air flow through the dissipator which enhances the evaporation of water therefrom.

In addition, water accumulated in the collection pan is evaporated by the heating element with such water, in turn, condensing on portions of the dissipator remote from the heating element. This newly condensed water is, in turn, evaporated by the dissipator means.

BRIEF DESCRIPTION OF THE DRAWINGS

A better understanding of the present invention may be had by reference to the following detailed description, taken in conjunction with the accompanying drawings, in which.

DETAILED DESCRIPTION

Figure 2:
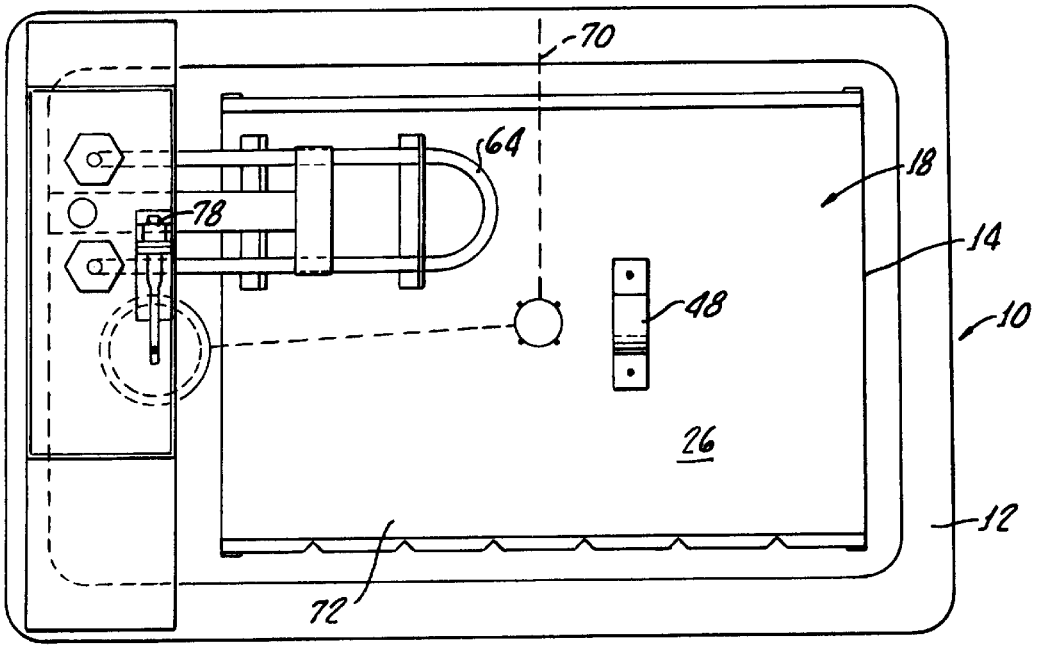
FIG. 2 is a top view of the dissipator shown in FIG. 1.
Figure 1:
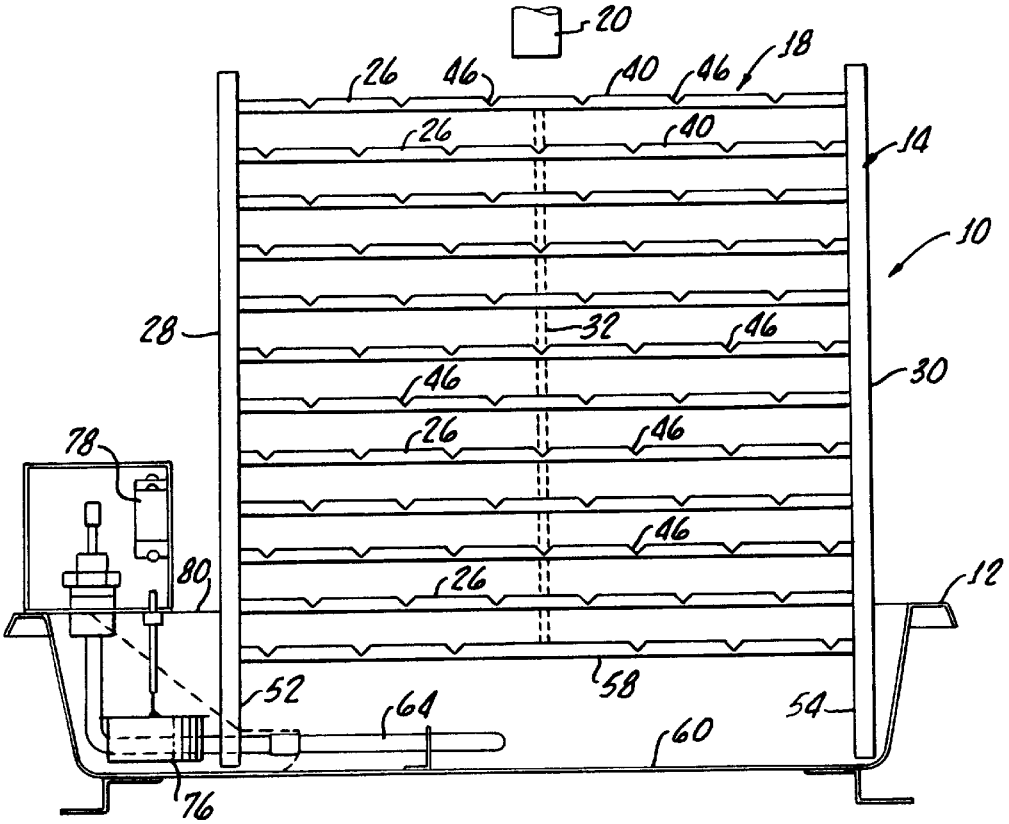
FIG. 1 is a side view of the present invention, in partial cross section, generally showing dissipator means consisting of a plurality of pans, a collection pan and a heating element disposed under a portion of the dissipator means.
Figure 3:
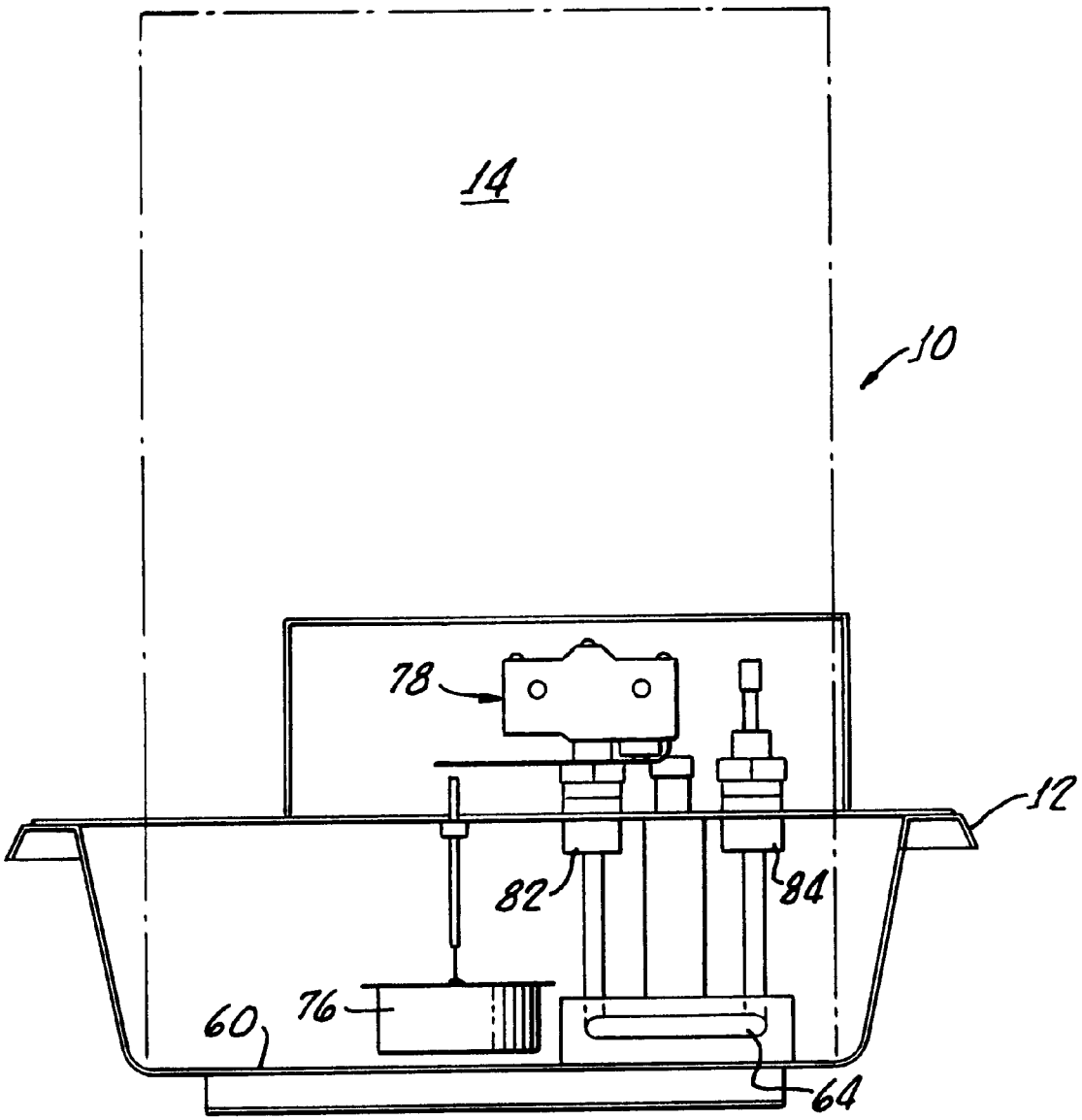
FIG. 3 is a front view and partial cross section of the dissipator shown in FIGS. 1 and 2.

With reference to FIGS. 1–3, there is shown condenser evaporator apparatus 10 for a refrigeration unit (not shown), which generally includes a collection pan 12 and a dissipator 14 disposed directly over the pan 12 which provides a means for evaporating water introduced thereinto and for directing unevaporated water into the collection pan as hereinafter described. Water may be introduced to a top 18 of the dissipated body condensate pipe 20, for example. The collection pan 12 and dissipator may be formed from any suitable material, preferably, a stainless steel.

The dissipator 14 includes a plurality of pans 26 fixed in a spaced apart relationship with one another between sides 28, 30 of the dissipator 14, a center piece 32 may be provided to stabilize the pans 26 and maintain the spaced apart relationship therebetween.

Importantly, each of the pans 26 include a rim 40 which causes water to coat each of the plurality of pans 26 before cascading to an underlying pan 26.

To facilitate the downward movement of water, each rim 40 includes a plurality of spillways 46 which enables water to spill onto an underlying pan 26.

As shown in FIG. 2, a handle 48 may be provided at the top 18 of the dissipator 14 for removal from the collection pan 12 for cleaning.

Because the dissipator 14 is disposed directly over the pan 12 and the majority of evaporation occurs in the pans 26, accumulation of foreign matter in the pan itself is minimized. Accordingly, cleaning of the apparatus is accomplished by mere removal of the dissipator 14 from the pan 12 including thereof. This enables the collection pan 12 to be permanently fixed to a refrigerator unit (not shown).

As shown, the dissipator is supported by depending portions 52, 54 of the sides 28, 30 which suspends the lower most pan 58 above a bottom 60 of the collection pan 12.

An electrical heating element 64 provides heating means for selectively heating the dissipator means 14 in order to enhance evaporation of water therefrom. The heating elements 64 is disposed beneath the dissipator means for not only evaporating water in the collection pan, but, as hereinabove noted, heating the dissipator means 14 in order to enhance the evaporation of water therefrom. This is accomplished by appropriate placement of the heating element 64 beneath the dissipator means. Preferably, the heating element 64 is disposed only under a portion, for example, a quadrant 70 indicated by the dashed line in FIG. 2. This selected position causes circulation of heated air and evaporated moisture throughout the dissipator which enables portions 72 of the evaporator 14 and pans 26 remote from the heating element to condense water evaporated from the pan 12 by the heating element 64, thus reintroducing the water into the dissipator means for continued evaporation thereof. Operation of the system by operation of the heating element is continued until a water level (not shown) in the pan reaches a selected level.

In that regard, a float 76 disposed in the collection pan provides a means for detecting a selected level of water in the collection pan and providing an output corresponding thereto for turning on the electrical element 64 by way of a switch 78 which provides a control means for actuating heating element 64 in response to movement of the float means which corresponds to a selected water level.

The float 76 is conveniently disposed beneath a deck 80 portion of the pan 12. The heating element is supported from the deck 80 by way of insulators 82, 84.

In operation, water introduced into the dissipator 14 via the condensate pipe 20 flows onto the individual pans 26 covering each pan which provides a large evaporation area. Continued filling of a pan causes spilling of water through the spillways 26 to underlying pans 26 which continues until the water reaches the collection pan 12. Depending upon atmospheric conditions and temperatures, the dissipator is operable without activation of the heating element 64.

However, when sufficient water reaches the collection pan 12, the float 76 turns on the heating element which causes evaporation of water therein. This evaporated water passes upwardly through the pans 26 where it condenses for a repeated evaporation cycle. Importantly, the heater selectively heats only one quadrant of the pan to promote circulation of evaporated water and selected heating of the dissipator to cause air circulation therein. This enhances the efficiency of the unit.

Additionally, as hereinabove noted, the apparatus is easily cleaned by removal of the dissipator from the pan. In view of the large surface areas provided by the dissipator, little or no debris or foreign matter reaches the collection pan. Accordingly, complete cleaning of the unit is easily accomplished by removal of the dissipator from the pan.

Although there has been hereinabove described a condensate evaporator apparatus in accordance with the present invention, for the purpose of illustrating the manner in which the invention may be used to advantage, it will be appreciated that the invention is not limited thereto. Accordingly, all modifications, variations or equivalent arrangements which may occur to those skilled in the art, should be considered to be within the scope of the invention as defined in the appended claims.

What is claimed is:

1. Condensate evaporator apparatus for a refrigeration unit, said condensate evaporator apparatus comprising:

a collection pan;

dissipater means, disposed directly over said collection pan, for evaporating water introduced thereinto and for directing unevaporated water into said collection pan, said dissipater means comprising a plurality of pans fixed in a spaced apart relationship with one another;

each of the plurality of pans including a rim for causing water to coat each of the plurality of pans;

a heating element, disposed within said collection pan and beneath said dissipater means, for evaporating water in said collection pan and heating said dissipater means, the dissipater means heating causing enhanced evaporation of water from said dissipater means;

means for detecting a selected level of water in said collection pan and providing an output corresponding thereto; and control means for activating said heating element in response to the detecting means output.

2. The condensate evaporator according to claim 1 wherein each rim includes spillway means for enabling water to spill onto an underlying pan.

3. The condensate evaporator according to claim 2 wherein said heating element is disposed only under a portion of said dissipator means in order to cause circulation of heater and evaporated water through said dissipator means.

4. The condensate evaporator according to claim 3 wherein said heating element is disposed adjacent sides of the plurality of pans opposite said spillway means.

5. The condensate evaporator according to claim 4 wherein said heating element is disposed only under one quadrant of the plurality of pans.

6. Condensate evaporator apparatus for a refrigeration unit, said condensate evaporation apparatus comprising:

a collection pan;

dissipater means, disposed directly over said collection pan, for evaporating water introduced thereinto and for directing unevaporated water into said collector pan, said dissipater means comprising a plurality of pans fixed in a spaced apart relationship with one another, each of the plurality of pans including a rim for causing water to coat each of the plurality of pans; and heating means for selectively heating said dissipater means in order to enhance evaporation of water therefrom.

7. The condensate evaporator according to claim 6 wherein said heating means comprises an electrical element disposed in said collection pan.

8. The condensate evaporator according to claim 7 further comprising float means disposed in said collection pan, for turning on the electrical element in response to a level of water accumulated in said condensate pan.

9. The condensate evaporator according to claim 8 wherein each rim includes spillway means for enabling water to spill onto an underlying pan.

10. The condensate evaporator according to claim 9 wherein said heating element is disposed only under a portion of said dissipator means in order to cause circulation of heat and evaporated water through said dissipator means.

11. The condensate evaporator according to claim 10 wherein said heating element is disposed adjacent sides of the plurality of pans opposite said spillway means.

12. The condensate evaporator according to claim 11 wherein said heating element is disposed only under one quadrant of the plurality of pans.

* * * * *